US011745245B2

(12) United States Patent
Kumagai et al.

(10) Patent No.: US 11,745,245 B2
(45) Date of Patent: Sep. 5, 2023

(54) METALLIC WORKED ARTICLES

(71) Applicant: TOYO SEIKAN GROUP HOLDINGS, LTD., Tokyo (JP)

(72) Inventors: Takuho Kumagai, Yokohama (JP); Ryozo Shiroishi, Yokohama (JP); Naoya Matsumoto, Yokohama (JP); Masahiro Shimamura, Yokohama (JP); Tomohiro Ogawa, Yokohama (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 0 days.

(21) Appl. No.: 17/041,601

(22) PCT Filed: Mar. 14, 2019

(86) PCT No.: PCT/JP2019/010478
§ 371 (c)(1),
(2) Date: Sep. 25, 2020

(87) PCT Pub. No.: WO2019/188324
PCT Pub. Date: Oct. 3, 2019

(65) Prior Publication Data

US 2021/0023603 A1 Jan. 28, 2021

(30) Foreign Application Priority Data

Mar. 26, 2018 (JP) ..... 2018-058484

(51) Int. Cl.
*B21D 22/28* (2006.01)
*B21D 51/26* (2006.01)
(Continued)

(52) U.S. Cl.
CPC ..... *B21D 22/28* (2013.01); *B21D 51/26* (2013.01); *B21D 22/30* (2013.01); *B65D 1/40* (2013.01)

(58) Field of Classification Search
CPC ..... B21D 22/28; B21D 51/26; B21D 22/30; B21D 22/24; B21D 22/286; B65D 1/40;
(Continued)

(56) References Cited

U.S. PATENT DOCUMENTS

2013/0205862 A1 8/2013 Takahashi et al.
2015/0083731 A1 3/2015 Skopis
(Continued)

FOREIGN PATENT DOCUMENTS

CN 103311706 A 9/2013
JP 10-137861 A 5/1998
(Continued)

OTHER PUBLICATIONS

International search report for PCT/JP2019/010478 dated Jun. 11, 2019.
(Continued)

*Primary Examiner* — Shelley M Self
*Assistant Examiner* — Teresa A Guthrie
(74) *Attorney, Agent, or Firm* — Sughrue Mion, PLLC

(57) ABSTRACT

A metallic worked article suppressing the worked surfaces from being scratched during the plastic work that is conducted aiming at reducing the thickness or decreasing the diameter. The metallic worked article has a reduced thickness or a decreased diameter as obtained through the plastic work, wherein on the worked surface thereof, the ratio Ra1/Ra2 of an arithmetic mean roughness Ra1 measured in a direction at right angles with the direction of working and an arithmetic mean roughness Ra2 measured in the direction of working, is from 0.5 to 1.5.

2 Claims, 2 Drawing Sheets

(51) Int. Cl.
*B21D 22/30* (2006.01)
*B65D 1/40* (2006.01)

(58) Field of Classification Search
CPC ..... B65D 1/12; B65D 1/165; Y10T 428/26; Y10T 428/13; Y10T 428/12993; Y10T 428/12292; Y10T 428/12229; Y10T 428/12236; Y10T 428/1225; G01N 21/17; G01N 2021/4711; G01N 2021/4704–4726; G01N 21/55–2021/575
USPC ..... 72/349
See application file for complete search history.

(56) References Cited

U.S. PATENT DOCUMENTS

| | | | | |
|---|---|---|---|---|
| 2015/0083737 | A1* | 3/2015 | Lino | B29C 49/6454 220/675 |
| 2015/0210431 | A1* | 7/2015 | Togo | B65D 25/14 206/524.3 |
| 2016/0288195 | A1 | 10/2016 | Rostaing et al. | |
| 2018/0229287 | A1 | 8/2018 | Kumagai et al. | |
| 2018/0301838 | A1 | 10/2018 | Tsuru et al. | |
| 2020/0071017 | A1 | 3/2020 | Hirota et al. | |

FOREIGN PATENT DOCUMENTS

| | | | |
|---|---|---|---|
| JP | 2010-227971 | A | 10/2010 |
| JP | 2010-240990 | A | 10/2010 |
| JP | 2013-163187 | A | 8/2013 |
| JP | 2014-128813 | A | 7/2014 |
| WO | 2012/128098 | A1 | 9/2012 |
| WO | 2015/075324 | A1 | 5/2015 |
| WO | 2017/033791 | A1 | 3/2017 |
| WO | 2018/079434 | A1 | 5/2018 |

OTHER PUBLICATIONS

Communication dated Feb. 28, 2022 from the Japanese Patent Office in Application No. 2018-058484.
Communication dated Dec. 15, 2021 from the China National Intellectual Property Administration in Chinese Application No. 201980021809.3.
Liu Guojie et al., "NewTechnologies in Modern Coating Technology", China Light Industry Publishing House, pp. 384-385 (4 pages total).
Extended European Search Report dated Nov. 26, 2021, issued by the European Patent Office in application No. 19775966.5.

* cited by examiner

METALLIC WORKED ARTICLES

CROSS-REFERENCE TO RELATED APPLICATIONS

This application is a National Stage of International Application No. PCT/JP2019/010478 filed Mar. 14, 2019, which claims priority under U.S.C. § 119(a) to Japanese Patent Application No. JP2018-058484 filed on Mar. 26, 2018.

TECHNICAL FIELD

This invention relates to metallic worked articles such as draw-ironed blank cans. More specifically, the invention relates to metallic worked articles suppressing the worked surfaces from being scratched during the plastic work.

BACKGROUND ART

Aluminum cans widely used for containing beverages include two-piece aluminum cans (DI cans) that are produced through the draw-ironing work using a liquid such as coolant. The aluminum cans are, generally, continuously produced in a factory. As the cans are produced in increased numbers increases, however, there occurs such a problem that the metal of the material being worked adheres to the ironing die that is used for the draw-ironing work. If the metal-adhered die is continuously used to execute the ironing work, the outer surface of the can wall is finely and longitudinally scratched in a direction in parallel with the direction of ironing, i.e., in the direction of height of the can. The can wall that is longitudinally scratched on the outer surface thereof results in a decrease in the specularity of the outer surface of the can wall and spoils the appearance causing the mirror image to be viewed differently depending upon the direction in which a person sees it. Therefore, it has been urged to establish a technology for suppressing the adhesion of metal.

As a technology to meet the above requirement, a patent document 1 proposes a draw-ironing work method by using, as the die in the ironing path in at least the last step in the ironing work, a die that is covered with a hard thin film of a Vickers' hardness of not less than 2500 on the surface of the die base material on the side that comes in contact with the metal blank, the hard thin film having a surface roughness Ra of not more than 0.05 μm. That is, according to the draw-ironing work method of the patent document 1, the ironing work is done by using the die provided with a flat and hard film to suppress the adhesion of metal on the surface of the die.

PRIOR ART DOCUMENT

Patent Document

Patent document 1: Japanese Patent Laid-Open No. 10-137861

OUTLINE OF THE INVENTION

Problems that the Invention is to Solve

According to the study conducted by the present inventors, however, the hard film of the die disclosed in the patent document 1 is formed of diamond-like carbon or the like. Further, the hard film of this kind has problems; e.g., the hard film is likely to be easily peeled off, has a low durability and its effect for suppressing the adhesion is not enough under conditions where high surface pressures are exerted. Therefore, the draw-ironing work method of the patent document 1 cannot be applied to the production of beverage cans that are produced under severe working conditions, but can be used in only limited field of applications.

The present inventors have previously filed patent applications concerning cans that are free of linear work traces and that are also excellent in brilliancy (Japanese Patent Applications Nos. 2016-208532 and 2016-208533). Such cans, however, are obtained through the draw-ironing work under the so-called dry condition without using the coolant. In many cases, however, the draw-ironing work is executed under the wet condition using a coolant. It has, therefore, been desired to establish a technology for avoiding the adhesion of metal, that can be applied even when the draw-ironing work is executed under the wet condition.

It is, therefore, an object of the present invention to provide metallic worked articles suppressing the worked surfaces from being scratched during the plastic work that is conducted aiming at reducing the thickness or decreasing the diameter.

Means for Solving the Problems

According to the present invention, there is provided a metallic worked article having a reduced thickness or a decreased diameter obtained through the plastic work, wherein on the worked surface thereof, the ratio Ra1/Ra2 of an arithmetic mean roughness Ra1 measured in a direction at right angles with the direction of working and an arithmetic mean roughness Ra2 measured in the direction of working, is from 0.5 to 1.5.

In the metallic worked article of the invention, the following embodiments are preferred:

(1) The arithmetic mean roughness Ra1 measured in the direction at right angles with the direction of working is not more than 0.030 μm;

(2) When the light ray reflected by the worked surface is evaluated by the LCH method by using a multi-angle spectrophotometer, the ratio $L_{15w}/L_{15h}$ of a brightness value $L_{15h}$ of the light ray reflected at an angle of 15 degrees with respect to the specular light in the direction of working and a brightness value $L_{15w}$ of the light ray reflected at an angle of 15 degrees with respect to the specular light in the direction at right angles with the direction of working, is from 0.7 to 1.3 based on the light ray specularly reflected from the light ray that is incident at 45 degrees in the direction of working and in the direction at right angles with the direction of working, and the brightness value $L_{15h}$ in the direction of working is not less than 50;

(3) The metallic worked article is made of an aluminum alloy;

(4) The plastic work is an ironing work; and (5) The metallic worked article is a draw-ironed blank can obtained through the draw-ironing work.

According to the present invention, there is, further, provided a draw-ironed blank can made of an aluminum alloy through the draw-ironing work, wherein after the cans are continuously produced in a number of 35,000, the ratio Ra1/Ra2 of an arithmetic mean roughness Ra1 measured on the outer surface of the can wall in the circumferential direction thereof and an arithmetic mean roughness Ra2 measured on the outer surface of the can wall in the direction of height thereof, is from 0.5 to 1.5.

According to the present invention, there is further provided a method of producing a draw-ironed blank can, characterized in that a draw-formed can obtained by draw-forming a metallic disk is subjected to the draw-ironing work by using an ironing die provided with a diamond film and having a work surface of a surface roughness Ra of not more than 0.1 μm.

Here, the draw-ironed blank can stands for a formed body that is obtained through the draw-ironing work but before being subjected to the necking or the like work. Further, the worked surface stands for a surface on where an abrasion powder that is one of the causes of adhesion could occur due to the plastic work. In the case of the draw-ironed blank can, the worked surface stands for the outer surface of the can wall. In the case of a rolled sheet obtained through the rolling work by passing a metal sheet between the two rolls, both the front and back surfaces become the worked surfaces.

Effects of the Invention

Like the draw-ironed blank can obtained through the draw-ironing work, the metallic worked article of the present invention is obtained through the plastic work that is conducted aiming at reducing the thickness or decreasing the diameter. If the metallic worked article of the invention is measured for its surface roughness in the direction of working and in the direction at right angles with the direction of working, it will be learned that the surface roughness is small in both directions. This fact suggests that the worked surface has no linear work marks that stretch in the direction of working. Namely, in the case of the metallic worked article of the invention, the worked surface is suppressed from being scratched during the plastic work and, specifically, during the draw-ironing work in continuously producing the cans.

As described above, the metallic worked article having the worked surface with suppressed scratches thereon can be continuously produced maintaining stability through the plastic work by using a mold that has a work surface provided with a diamond film and having a surface roughness Ra of not larger than 0.1 μm.

MODES FOR CARRYING OUT THE INVENTION

Figure 1:
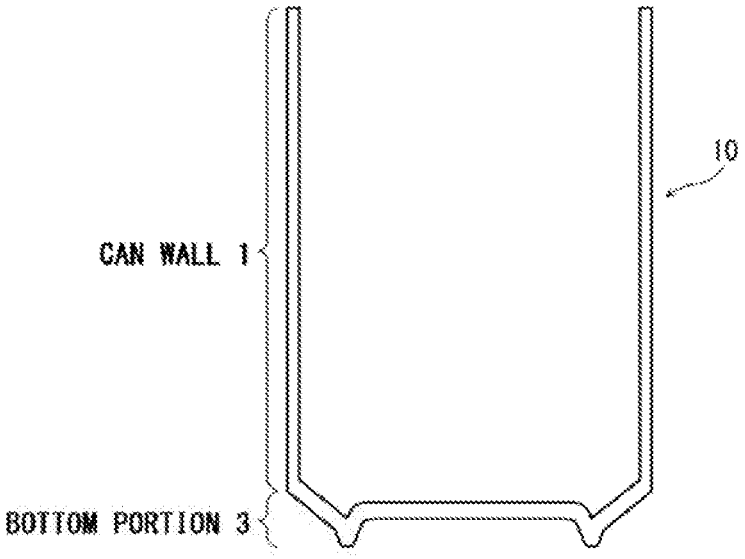
FIG. 1 is a schematic side sectional view of a blank can according to an embodiment of the present invention.

This invention is concerned to a metallic worked article, and one of its embodiments is, for example, a draw-ironed blank can (hereinafter simply called blank can). The blank can is obtained through the ironing work that will be described later, and is a formed body of before being subjected to the after-work such as necking work. Therefore, the blank can has a very simple form as shown in FIG. 1. The invention will now be described in detail by using the blank can.

Referring to FIG. 1, the blank can of the embodiment designated at 10 is of a bottomed cylindrical shape as a whole, and includes a straight can wall 1 stretching downward from an upper end thereof and a bottom portion 3 continuous to the lower end of the can wall 1.

In the blank can 10 of this embodiment, the outer surface which is the worked surface of the can wall has almost no longitudinal scratch that would stretch in the direction of height of the can. The blank can is produced in a manner as described below.

<Production of the Blank Cans>

The blank can of this embodiment is produced through the forming work by using chiefly a metal sheet that has been known per se. The metal sheet such as aluminum sheet put to the forming work may be of pure aluminum or an alloy of aluminum with other metal, such as an aluminum alloy containing magnesium, manganese, etc. Further, the sheet material may be iron, or other metal such as titanium or magnesium, or may be an alloy chiefly comprising other metals, or may be a plated plate such as tin plate. It is, however, desired that the metal sheet is of an aluminum alloy.

The surface of the metal sheet maybe coated with a resin, e.g., may be laminated with a thermoplastic resin film such as polyester resin as represented by polyethylene terephthalate. It is desired that the inner surface of the can is coated with a resin to enhance the corrosion resistance. Or after formed, the inner surface of the can is coated with a film by using such means as spray. The outer surface of the can is not coated with the resin since it impairs the specularity. Or even if coated, the coating should have a thickness of less than 100 nm. Moreover, a film may be formed on the surface of the metal sheet by anodic oxidation or conversion treatment. Desirably, however, no film should be formed since it impairs the specularity.

Figure 2A:
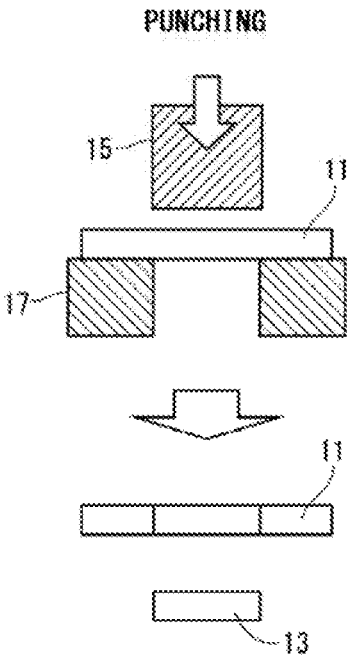
FIGS. 2(*a*) and 2(*b*) are views schematically illustrating a punching work and a drawing work for producing the blank can.
Figure 2B:
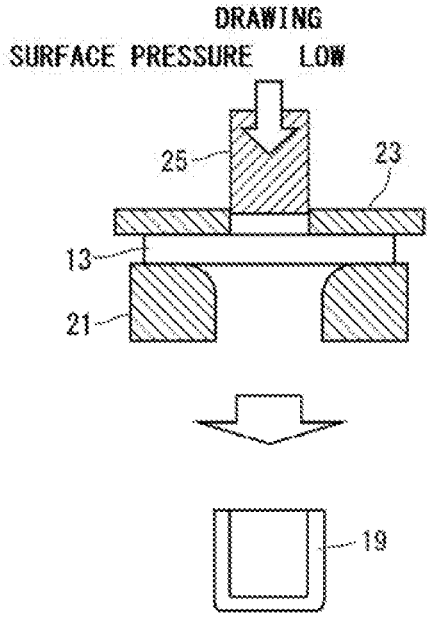
Figure 3:
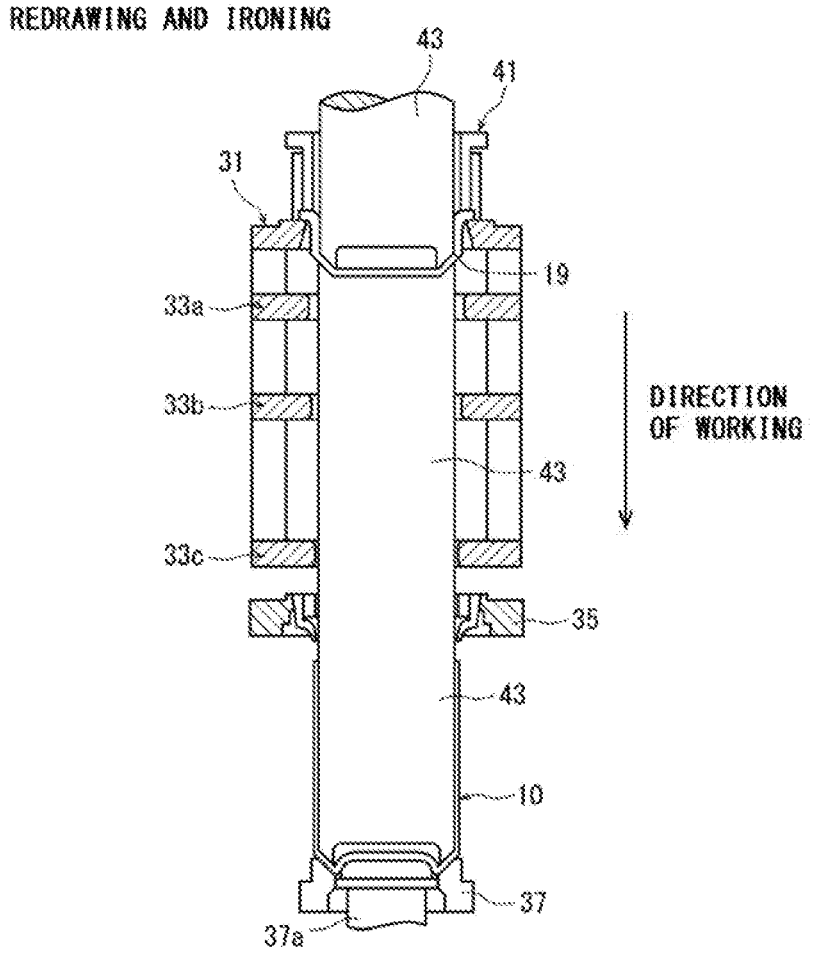
FIG. 3 is a view schematically illustrating a redraw-ironing work that is executed after the drawing work of FIGS. 2(*a*) and 2(*b*).

The metal sheet is subjected to the forming work that comprises the punching work, drawing work and redrawing work. FIGS. 2(*a*) and 2(*b*) schematically illustrate the punching work and the drawing work in the forming work. FIG. 3 schematically illustrates the redrawing work.

Referring to FIG. 2(*a*), a blank sheet 11 comprising the above-mentioned metal blank is, first, subjected to the punching work to obtain a disk (blank) 13 for a can (see FIG. 2(*a*)).

The punching work is carried out by using a punch 15 having an outer diameter corresponding to the diameter of the disk 13 and a die 17 that holds the blank sheet 11 and has an opening corresponding to the diameter of the disk 13. The disk 13 of a predetermined size is obtained by punching the blank sheet 11 held on the die 17 by using the punch 15.

The obtained disk 13 is subjected to the drawing work to obtain a draw-formed can of a small height (bottomed cylindrical body) 19 (see FIG. 2(*b*)).

In the drawing work, the disk 13 is held on the die 21. The circumference of the disk 13 is held by a blank holding jig 23. The die 21 has an opening. The draw-formed can 19 is obtained by pushing the disk 13 into the opening of the die 21 by using a drawing punch 25.

The corner portion at the upper end of the opening of the die 21 (on the side of holding the disk 13) is curved (curved portion) enabling the disk 13 to be quickly pushed into the opening of the die 21 without being broken. The punch 25 has an outer diameter that is set to be smaller than the diameter of the opening of the die 21 by an amount nearly corresponding to the thickness of the disk 13. Therefore, the thickness is not almost reduced in the drawing work.

Next, the draw-formed can 19 obtained above is subjected to the redrawing work shown in FIG. 3. There is thus obtained a blank can body (blank can) 10 having an increased height and a small diameter.

In the redrawing work shown in FIG. 3, a ring-shaped redrawing die 31 and a plurality of ironing dies 33*a* to 33*c* are arranged in this order. A guide ring 35 is arranged on the downstream of the ironing die 33*c* that is positioned on the most downstream side in the direction of working. On the more downstream side, there are arranged a holder ring 37 for forming the bottom portion and a holder rod 37*a* in this order.

The ironing dies 33*a* to 33*c* have such shapes that their diameters become smaller stepwise toward the downstream in the direction of working to thereby execute the reduction of thickness.

To conduct the redrawing work, the draw-formed can 19 is held on the redrawing die 31 by using a holder 41. In this state, an ironing punch 43 is inserted in the draw-formed can 19. The punch 43 is then moved in the direction of working while bringing the outer surface of the draw-formed can 19 into pressed contact with the inner surfaces (work surfaces) of the dies 31, 33*a* to 33*c* to execute the redrawing work through which the side wall of the draw-formed can 19 acquires a reduced thickness. There is thus obtained a blank can 10 having a reduced thickness and an increased height depending on the degree of reduction in the thickness. When a wet condition is employed in this case, a liquid such as coolant is suitably fed onto the surface being worked so that the ironing work will not be conducted out of lubrication.

Further, the end of the ironing punch 43 is tapered and becomes slim to meet the bottom portion 3 of the blank can 10. The holder ring 37 is so provided as to slide along the direction of working. The holder rod 37*a* is inserted in the central portion of the ring 37. The inner circumferential surface of the holder ring 37 and the upper end of the holder rod 37*a* are so shaped as to meet the bottom portion of the blank can 10.

That is, the draw-formed can 19 is pushed by the ironing punch 43 to pass through the dies 31, 33*a* to 33*c*. Further, the bottom portion of the worked article which is the draw-formed and ironed can 19 is pushed onto the holder ring 37 and the holder rod 37*a*. Therefore, the bottom portion is imparted with a predetermined bottom shape and thus the blank can 10 is obtained. After the blank can 10 is formed as described above, the ironing punch 43 moves toward the upstream in the direction of working. The obtained blank can 10 is held by the guide ring 35 and is pulled from the ironing punch 43. The blank can 10 is thus taken out.

The blank can 10 is subjected to the after-works such as trimming, necking, wrap-seaming and the like work before it is really put into a practical use.

In FIG. 3, there are arranged three ironing dies to carry out the ironing work in three steps. The number of the ironing dies, however, is not limited to three only but can be any number depending on the desired degree of reducing the thickness and the height of the can. The ironing work may be carried out in one step only using a single die. Or the dies may be arranged in a larger number to carry out the ironing work through a plurality of steps. When the ironing dies are arranged in a plural number along the direction of working to carry out the ironing work through a plurality of steps, the inner diameter (work diameter) becomes smaller toward the downstream in the direction of working, as a matter of course as described above.

For instance, the above-mentioned ironing work is, in general, carried out by using ironing dies having a suitable diameter in a suitable number such that the ironing ratio defined by the following formula becomes not larger than 50%.

$$\text{Ironing ratio (\%)}=\{(\text{thickness of before the ironing work}-\text{thickness of after the ironing work})/\text{thickness of before the ironing work}\}\times 100$$

The ironing work can be carried out under either a wet condition where a liquid such as coolant is continuously flown or a dry condition where no coolant is used. However, the ironing work under the wet condition is preferred from the standpoint of easily obtaining smooth outer surfaces.

As will be described later in detail, when the redraw-ironing work is executed under the wet condition, the outer surface of the can wall of the finally obtained blank can appears to be whitish as compared to that of when the redraw-ironing work is executed under the dry condition. This is because since the coolant is made present between the mold and the worked surface, the surface of the mold is transferred at a decreased ratio onto the outer surface of the can wall. Accordingly, the outer surface of the can wall is roughened, and the ratio of irregular reflected light rays increases per the totally reflected light rays.

In the invention, it is necessary that the ironing dies 33*a* to 33*c* have been provided with a diamond film on the work surfaces thereof (surfaces that come into contact with the outer surface of the draw-formed can 19 that is to be ironed) and that the diamond film has been polished to acquire a high degree of smoothness. Even when the ironing work is to be carried out by arranging the dies in a number other than three, it is necessary that the ironing die of at least the final step must be provided with such a diamond film on the work surface thereof.

The ironing work by using the dies provided with the diamond film helps effectively avoid the outer surface of the obtained blank can 10 from getting linear work traces in the direction of ironing. This is because the diamond film remains chemically stable, reacts little with the metal of the workpiece and, further, has excellent durability because of its high degree of hardness. Even the diamond-like carbon film (DLC film) is not comparable with the diamond film in hardness.

There can be exemplified a cemented carbide as a blank material for forming the surface of the ironing die that has heretofore been widely used. However, the metal of the workpiece adheres to the cemented carbide on the surfaces. If the metal-adhered die is continuously used, the outer surface of the can wall gets longitudinally scratched in the direction of height of the can and finally results in a breakage.

Let it be presumed, for example, the cans are continuously produced in a factory of producing beverage cans. In this case, when the ironing dies having surfaces made of the cemented carbide are used, it becomes necessary to remove the metal that has adhered for every preset period of time though it may vary depending on the rate of producing the cans and the like factors. If the diamond film is used, then the frequency of removing the adhered metal can be greatly decreased. In practice, as will be demonstrated in Examples appearing later, the cans were continuously produced by using the same molds without polishing them. When there were used the molds that were entirely made of the cemented carbide, however, the outer surface of the can wall became rough in the circumferential direction with an increase in the number of the cans that were produced. After the cans were produced in a number of 35,000 or more, the blank can could not be obtained satisfying the requirement (Ra1/Ra2) specified by the present invention. When there were used the molds provided with the diamond film on the surfaces thereof, on the other hand, even after the cans were produced in a number of 35,000 or more, the roughness on the outer surfaces of the can walls was the same as that of when the production of the cans was just started. Eventually, the roughness remained the same as that of when the production was just started even after the cans were produced in a number in excess of 160,000.

In recent years, furthermore, attention has been given to the diamond-like carbon film (DLC film) that is formed on the surfaces. The DLC film, however, contains much impurities as compared to the diamond film, and has a low crystallinity. Therefore, the DLC film is removed easily and has a low degree of durability. Moreover, during the ironing work in continuously producing the beverage cans, a particularly high surface pressure is repetitively exerted on the ironing dies. In such a case, it has been known that the DLC film is little effective in suppressing the adhesion of metals under the application of a high surface pressure.

The diamond film is, usually, provided on at least the work surfaces of the ironing dies 33*a* to 33*c* made of a rigid base material that is used. As the rigid base material, there is used a material having a rigidity large enough to withstand a severe ironing work accompanied by a high surface pressure and a heat resistance large enough to withstand the heating at a high temperature at the time of forming the diamond film. As such materials, there can be exemplified the so-called cemented carbide obtained by sintering a mixture of tungsten carbide (WC) and a metal binder such as cobalt, cermet obtained by sintering a mixture of a metal carbide such as titanium carbide (TiC) or a titanium compound such as titanium carbonitride (TiCN) and a metal binder such as nickel or cobalt, and hard ceramics such as silicon carbide (SiC), silicon nitride ($Si_3N_4$), alumina ($Al_2O_3$) and zirconia ($ZrO_2$).

As the diamond film to be formed on the work surfaces of the ironing dies (dies for ironing) made of the above-mentioned rigid base material, though there is no specific limitation, there can be preferably used a film having an intensity ratio represented, for example, by the following formula (1):

$$I_D/I_G \quad (1)$$

wherein, $I_D$ is a maximum peak intensity at 1333±10 $cm^{-1}$ in the Raman spectrum on the surface of the carbon film, and $I_G$ is a maximum peak intensity at 1500±100 $cm^{-1}$ in the Raman spectrum on the surface of the carbon film, of not less than 1.0 and, preferably, not less than 1.2.

The peak intensity $I_D$ comes from the diamond component in the film while the peak intensity $I_G$ comes from the graphite component in the film. Therefore, the larger the above peak intensity ratio, the smaller the graphite content and there is formed a film closer to the diamond crystals (diamond film of a high purity).

This diamond film is a very highly hard film with a Vickers' hardness of not less than 8000, and has a high chemical stability and, further, suppresses the reaction in the interface with the material being worked. This improves the slipping property and hence provides very high durability against the severe ironing work. The diamond film having the peak intensity ratio smaller than the above range, contains much components other than the diamond component such as graphite, has low slipping property, has small durability against the ironing work and, therefore, tends to cause defective forming.

Here, if the peak intensity ratio is too large, the film becomes brittle and may have decreased durability. It is, therefore, desired that the peak intensity ratio is not more than 5.

The diamond film having the above-mentioned peak intensity ratio is realized by forming a film on the surface of the rigid base material relying on a known method such as the plasma CVD method, e.g., hot filament DVD, microwave plasma CVD or high-frequency plasma CVD.

To form the film, there is, usually, used, as the starting gas, a gas obtained by diluting a hydrocarbon gas such as methane, ethane, propane or acetylene with a hydrogen gas to about 1%. To adjust the quality of film and the rate of forming the film, the starting gas will often be mixed with a small amount of gas such as oxygen, carbon monoxide or carbon dioxide. By using the starting gas, the rigid base material is heated at a temperature as high as 700 to 1000° C. and a plasma is generated by utilizing the microwaves or the high-frequency waves. The starting gas is, therefore, decomposed in the plasma to form active species, and diamond crystals are grown the rigid base material to thereby form the film. In forming the film, hydrogen atoms dissociated in the plasma work to selectively etch the graphite and amorphous carbon formed on the rigid base material. The diamond component can be thus increased, and the peak intensity ratio in the Raman spectrum of the film can be set to lie within the above-mentioned range.

The diamond film and, specifically, the diamond film having the peak intensity ratio as described above formed by such means as vapor deposition is accompanied by the etching of graphite or amorphous carbon permitting the diamond crystals to grow easily and causing the surfaces to become coarse. The diamond film is hard and is capable of withstanding severe ironing work. However, if the diamond film is used for the ironing work without polishing its surface, the can wall will be broken and the can cannot be formed. Or even if the can is formed, the outer surface of the can wall cannot be made smooth. It is, therefore, important that the diamond film has its surface polished so as to acquire a high degree of smoothness.

To obtain, for example, a blank can having a can wall featuring a smooth outer surface, the surface of the diamond film is polished to acquire the surface roughness Ra (JIS B-0601-1994) of not more than 0.1 μm and, specifically, not more than 0.05 μm. The lower limit is, usually, 0.005 μm.

The surface of the diamond film can be polished by a method known per se. For example, the surface of the diamond film may be polished in a mechanical manner of co-machining the carbon film by using the diamond grains (grind stone), or may be polished by utilizing the chemical action. Or the surface thereof may be polished by compounding the mechanical method and the chemical method together.

The blank can having the can wall featuring a smooth outer surface of the embodiment of the invention can be obtained through the punching work, drawing work and redraw-ironing work described above.

<Surface of the Blank Can>

(Surface Roughness)

Reverting to FIG. 1, in the blank can 10 of the embodiment thus obtained, despite the can is one of those that are continuously produced, the ratio Ra1 of an arithmetic mean roughness Ra1 measured on the outer surface of the can wall 1 in the circumferential direction thereof, i.e., in the direction at right angles with the direction of working and an arithmetic mean roughness Ra2 measured in the direction of height, i.e., in the direction of working, is from 0.5 to 1.5 and, preferably, from 0.8 to 1.2, which is close to 1. Moreover, it is desired that the arithmetic mean roughness Ra1 on the outer surface of the can wall 1 in the circumferential direction thereof is not more than 0.030 μm.

Here, if the can wall has fine longitudinal scratches in the outer surface thereof, the surface roughness Ra1 increases in the circumferential direction and, as a result, the ratio Ra1/Ra2 increases, too, though the surface roughness Ra2 in the direction of height of the can does not so change as compared to when there is no longitudinal scratch.

As for a maximum height of surface roughness Rz on the outer surface of the can wall 1 (JIS-B-0601-2001), like the arithmetic mean roughness Ra, the ratio Rz1/Rz2 of a value Rz1 in the circumferential direction and a value Rz2 in the direction of height is close to 1 and, concretely, is from 0.6 to 1.4 despite the can is one of those that are continuously produced.

(Specularity)

As described above, the blank can according to the embodiment, despite it is one of those cans that are continuously produced, has the can wall that features the smooth outer surface; i.e., the can wall features the specular outer surface.

Concretely speaking, the specularity can be evaluated relying on the specular reflectance. The higher the specularity, the higher the specular reflectance and the less the light is scattered by the irregular reflection. The invention uses a multi-angle spectrophotometer, and permits the light rays of wavelengths of 400 to 800 nm to be incident on the worked surface in the circumferential direction at an angle of 5 degrees relative to the worked surface. In this case, the incident light ray of each wavelength was highly and specularly reflected. Desirably, the light rays were specularly reflected at ratios of 73 to 90% at the wavelengths of 680±50 nm.

The light rays were also permitted to be incident in the directions other than the direction of height of the can, and the specular reflectances were also measured. The incident light ray of each wavelength was highly and specularly reflected. Desirably, the specular reflectance was 73 to 90% at the wavelengths of 680±50nm. According to the present invention as described above, high specular reflectances were exhibited either when the light ray was measured in the circumferential direction or when the light ray was measured in the direction of height of the can. Namely, the can maintains a high degree of specularity not only in a specific direction but also in any direction in which a person would see the high degree of specularity.

If the can wall has work traces on the outer surface thereof, the specular reflectance decreases in the circumferential direction though the specular reflectance does not much change in the direction of height of the can.

Presence of specularity can be confirmed from the viewpoint of specular reflectance, as described above. It can be, further, confirmed by measuring the worked surface by using the multi-angle spectrophotometer and by observing the irregularly reflected light rays.

Specifically, when a worked surface that is curved, such as the outer surface of the can wall, is observed with the eye under a condition where the light is incident in large amounts like being illuminated with a fluorescent lamp, the mirror image of the source of light reflected on the worked surface is so white and glaring that it would be difficult to determine if there are scratches on the worked surface due to the blinding glare. Even in such a case, however, presence of the specularity can be, usually, recognized by confirming, with the eye, the state of irregular reflection (brightness of the image reflected around the mirror image of the source of light, etc.). As described above, it is meaningful to measure the irregularly reflected light as a measure to observe the surface with the eye in an extremely bright environment.

Figure 4:
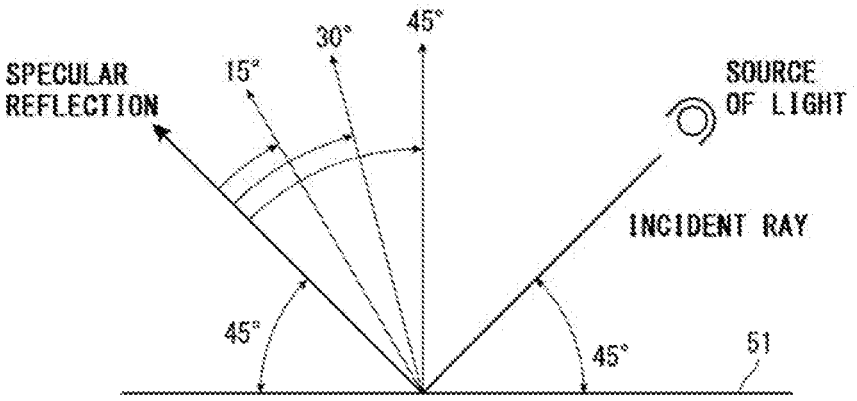
FIG. 4 is a view illustrating the principle of evaluating the reflected light rays by using a multi-angle spectrophotometer.

The principle of the multi-angle spectrophotometer will now be described with reference to FIG. 4. In FIG. 4, the specular light ray of the light ray (incident light) incident on a predetermined base plate surface 51 (represents the outer surface of the can wall of the blank can) at an angle of 45 degrees relative to the surface 51, is a light ray that is axisymmetric with respect to a perpendicular drawn to the base plate surface 51 and is reflecting in a direction of 45 degrees relative to the base plate surface 51. Presuming that the worked surface would be viewed from a variety of angles, measurement is taken of the light rays reflected in the directions of 15, 30 and 45 degrees relative to the specular light. In general, it has been said that the light is irregularly reflected little if it has an angle larger than 45 degrees relative to the specular light.

Concretely speaking, by using the multi-angle spectrophotometer, the worked surface (outer surface of the can wall in the case of the blank can) is measured for the L-values (brightness) of the reflected light rays that have angles as described above with respect to the specular light relying on an LCH method.

The LCH method will now be described. Methods of displaying color space include an L*a*b* method (also called Lab method) and the LCH method. The L*a*b* method displays the color space using the Cartesian coordinates (rectangular coordinates) while the LCH method displays it using polar coordinates. With the LCH method, a color is displayed using L, C and h which have the following meanings. Namely, L represents brightness (brilliance) which becomes dark as the value approaches 0 and becomes bright as the value becomes large. On the other hand, C represents saturation (vividness) which is turbid when the value is small and becomes vivid as the value increases. Further, h is a hue angle represented by a numerical value over a range of from 0 to 360. The hue h is red, orange or yellow in a range of from 0 to 90, yellow, yellowish green or green in a range of from 90 to 180, green, cyan (bluish green) or blue in a range of 180 to 270, and blue, violet or magenta in a range of 260 to 360.

The invention uses, as a reference, the specular light ray reflected from the incident light ray incident at an angle of 45 degrees relative to the direction of height of the can. Moreover, the invention measures the L-values (brightness) of the reflected light rays that have angles of 15 to 45 degrees (every 15 degrees) relative to the specular light ray and, further, similarly measures the L-values (brightness) of the reflected light rays that have angles of 15 to 45 degrees (every 15 degrees) but permitting the light ray to be incident in the circumferential direction. In this case, the reflected light rays of any angles show L-values that are close to each other in both the direction of height of the can and in the circumferential direction thereof. Hereinafter, the reflected light ray having an angle of 15 degrees relative to the specular light ray is called 15-degree reflected ray. For example, the ratio $L_{15w}/L_{15h}$ of a brightness value $L_{15h}$ of the 15-degree reflected ray in the direction of height of the can and a brightness value $L_{15w}$ of the 15-degree reflected ray in the circumferential direction, is from 0.7 to 1.3, preferably, from 0.8 to 1.2, and becomes close to 1. In the present invention as described above, the irregular reflection is also very similar in both the direction of height of the can and the circumferential direction manifesting that the worked surface is free of scratches in both the direction of working and the direction at right angles with the direction of working.

The blank can of the embodiment is made from a metal sheet through the ironing work by using an ironing die that has a specific diamond film on the work surface thereof. When a wet condition is employed for the draw-ironing work, the brightness increases in the irregularly reflected rays of the mirror image reflected on the outer surface of the can wall as described earlier, and the mirror image tends to appear whitish. In fact, when the wet condition is employed for the redraw-ironing work, the brightness value $L_{15h}$ becomes large in the 15-degree reflected ray in the direction of working and, desirably, becomes more than 50, and more preferably, becomes more than 50 but not more than 150. When the dry condition is employed, in general, the mold is transferred onto the worked surface at an increased ratio and hence a higher specularity is obtained, suppressing the brightness $L_{15h}$ of the 15-degree reflected ray to be not more than 50 in the direction of working in which the light is irregularly reflected.

In this specification, the invention was described with reference to the blank can. The invention, however, is in no way limited to the blank can only but is capable of assuming a variety of embodiments so far as they are the metallic worked articles having a reduced thickness or a decreased diameter through the plastic work yet having the above-mentioned features.

For example, the metallic worked article of the invention may be a rolled material obtained by reducing the thickness of the metal sheet through the rolling work. In this case, a direction in which the rolling roll revolves is the direction of working, and the surface that comes into direct contact with the rolling roll is the worked surface. When the metal sheet is rolled by passing it between the two rolling rolls that are facing each other, both the front surface and the back surface of the rolled material are the worked surfaces.

Moreover, the metallic worked article of the invention may be a stretched wire material having a decreased diameter obtained by passing a metallic rod material through a die having an opening that becomes narrow toward the end thereof.

EXAMPLES

The invention will now be described by way of the Examples. In the following Experimental Examples, the following methods were used to measure the surface roughness, specular reflectance and brightness.

<Surface Roughness Ra>

By using a surface roughness meter (SURFCOM 2000SD3) manufactured by Tokyo Seimitsu Co., the arithmetic mean roughness Ra was measured in compliance with the JIS-B-0601.

<5° Specular Reflectance>

By using a spectrophotometer, UV-3100PC, manufactured by Shimazu Seisakusho Co., the rays incident on the outer surface of the can wall at an angle of 5 degrees in the direction of working (direction of height of the can wall) and in the circumferential direction were measured for their specular reflectance. The outer surface of the can wall made from a rolled sheet as the starting material includes a region where the direction of rolling the sheet becomes in parallel with the direction of working as well as a region where the direction of rolling becomes at right angles with the direction of working. The measurements here were taken from both of these regions and were averaged.

<Brightness>

By using a multi-angle spectrophotometer manufactured by Videojet X-Rite Co., the ray reflected by the outer surface of the can wall of an aluminum can was evaluated based on the LCH method. Concretely speaking, based on the light rays specularly reflected from the light rays incident at an angle of 45 degrees in the direction of working (direction of height of the call wall) and in the circumferential direction of the can wall, there were measured the brightness $L_{15h}$ of the ray reflected at an angle of 15 degrees in the direction of working and the brightness $L_{15w}$ of the ray reflected at an angle of 15 degrees in the direction at right angles thereto in order to find a ratio $L_{15w}/L_{15h}$. Further, by using the same specular light rays as the reference, there were measured the brightness $L_{30h}$ of the ray reflected at an angle of 30 degrees in the direction of working and the brightness $L_{30w}$ of the ray reflected at an angle of 30 degrees in the direction at right angles thereto in order to find a ratio $L_{30w}/L_{30h}$. Moreover, by using the same specular light rays as the reference, there were measured the brightness $L_{45h}$ of the ray reflected at an angle of 45 degrees in the direction of working and the brightness $L_{45w}$ of the ray reflected at an angle of 45 degrees in the direction at right angles thereto in order to find a ratio $L_{45w}/L_{45h}$.

In measuring the brightness like in the case of the specular reflectance, too, measurements were taken from the region where the direction of rolling the sheet becomes in parallel with the direction of working as well as the region where the direction of rolling becomes at right angles with the direction of working. The measurements were then averaged.

Experimental Example 1

By using a general-purpose press, an aluminum alloy sheet A3004 having a thickness of 0.29 mm was punched into disks which were then draw-worked to form bottomed cylindrical bodies (draw-formed cans). Next, blank cans were produced through the draw-ironing work according to the procedure shown in FIG. 3. Prior to executing the punching, an ester type synthetic oil was applied to the aluminum alloy sheet. The draw-ironing work was conducted at a rate of about 200 to about 300 spm while the wet condition was established by supplying an emulsion liquid as the coolant. The draw-ironing work was executed by using a working die obtained by forming a diamond film on the surface of a cemented carbide base material that was a sintered mixture of tungsten carbide (WC) and a metal binder of cobalt, the diamond film having a surface roughness Ra of not more than 0.1 μm. The die used here was the one after having produced at least not less than 40,000 cans. The obtained blank cans are referred to here as Samples 1-1 and 1-2. The Samples 1-1 and 1-2 were measured for their roughness on the outer surfaces of the can walls thereof in the direction of working and in the circumferential direction at right angles with the direction of working. Table 1 shows the results of ratios thereof.

Experimental Example 2

Blank cans were obtained in the same manner as in Experimental Example 1 but using a die that was really used for the production, i.e., using a die of cemented carbide after having been used for the production of at least not less than 40,000 cans instead of using the draw-ironing die. The obtained blank cans are referred to as Samples 1-3 to 1-5.

The Samples 1-3 to 1-5 are the same products as those that have been placed in the market. The Samples 1-3 to 1-5 were measured for their roughness on the outer surfaces of the can walls thereof in the direction of working and in the circumferential direction at right angles with the direction of working. Table 1 shows the results of ratios thereof.

TABLE 1

| Sample | | Ra (μm) Direction at right angles Ra1 | Direction of working Ra2 | Ra1/Ra2 |
|---|---|---|---|---|
| 1-1 | this invention | 0.025 | 0.020 | 1.24 |
| 1-2 | this invention | 0.021 | 0.019 | 1.11 |
| 1-3 | conventional product | 0.031 | 0.020 | 1.55 |
| 1-4 | conventional product | 0.035 | 0.022 | 1.59 |
| 1-5 | conventional product | 0.033 | 0.019 | 1.73 |

Table 1 tells that when the surface roughness Ra is measured in the direction of working, the difference is small between the products of the invention and the conventional products. There, however, is a difference in the surface roughness when measured in the circumferential direction which is at right angles with the direction of working. The products of the present invention have an arithmetic mean roughness Ra which is not more than 0.030 μm. In terms of the ratio of roughness in the circumferential direction and in the direction of working, the conventional products have a ratio of not smaller than 1.5, i.e., have a low isotropy whereas the products of the present invention have a ratio of not larger than 1.5, i.e., have a high isotropy. This is in agreement with the scratched conditions as observed with the eye. This is because according to the present invention, metals are effectively prevented from adhering on the mold and hence the worked articles are suppressed from being scratched.

Experimental Examples 3 and 4

Next, in order to evaluate the specularities, the blank cans were measured for their 5° specular reflectances. A blank cans was produced in Experimental Example 3 in the same manner as in Experimental Example 1. Blank cans were also produced in Experimental Example 4 in the same manner as in Experimental Example 2. The blank can produced in Experimental Example 3 is referred to as Sample 2-1. The blank cans produced in Experimental Example 4 are referred to as Samples 2-2 and 2-3. The Sample 2-1 is the product of the present invention while the Samples 2-2 and 2-3 are the conventional products. The Samples 2-1 to 2-3 were measured for their 5° specular reflectances on the outer surfaces of the can walls thereof in the direction of working and in the circumferential direction at right angles with the direction of working. Table 2 shows the results thereof.

TABLE 2

| Sample | | Wavelength (nm) | Direction at right angles (%) | Direction of working (%) | Difference |
|---|---|---|---|---|---|
| 2-1 | this invention | 630 | 74.9 | 76.7 | 1.8 |
| | | 680 | 75.5 | 77.2 | 1.7 |
| | | 730 | 74.6 | 76.9 | 2.3 |

TABLE 2-continued

| Sample | | Wavelength (nm) | Direction at right angles (%) | Direction of working (%) | Difference |
|---|---|---|---|---|---|
| 2-2 | Conventional product | 630 | 66.3 | 71.7 | 5.4 |
| | | 680 | 67.1 | 72.1 | 5.0 |
| | | 730 | 67.1 | 72.1 | 5.0 |
| 2-3 | Conventional product | 630 | 70.9 | 76.7 | 5.8 |
| | | 680 | 72.2 | 76.9 | 4.7 |
| | | 730 | 71.4 | 76.7 | 5.3 |

Table 2 tells that when the specular reflectance is measured in the direction of working, there is seen no large difference between the products of the invention and the conventional products. Differences, however, occur between the products of the present invention and the conventional products when the specular reflectance is measured in the direction at right angles thereto. Concretely speaking, with the Samples 2-2 and 2-3 which are the conventional products, the reflectances in the direction at right angles are very smaller than the reflectances measured in the direction of working. With the Sample 2-1 which is the product of the present invention, on the other hand, the difference in the reflectance is small in the direction of working and in the direction at right angles thereto, and the reflectance is as high as 73% or more.

Experimental Examples 5 and 6

Irregularly reflected light rays were also measured by using the multi-angle spectrophotometer. Concretely, a blank can was produced in Experimental Example 5 in the same manner as in Experimental Example 1. Blank cans were also produced in Experimental Example 6 in the same manner as in Experimental Example 2. The blank can produced in Experimental Example 5 is referred to as Sample 3-1. The blank cans produced in Experimental Example 6 are referred to as Samples 3-2 and 3-3. The Sample 3-1 is the product of the present invention while the Samples 3-2 and 3-3 are the conventional products. The Samples 3-1 to 3-3 were measured for their brightness L-values on the outer surfaces of the can walls thereof in the direction of working and in the direction at right angles thereto. Table 3 shows the L-values and their ratios.

TABLE 3

| Sample | | Deflected angle | Direction at right angles (—) | Direction of working (—) | Right angles/ direction of working |
|---|---|---|---|---|---|
| 3-1 | this invention | 15 | 75.9 | 68.4 | 1.11 |
| | | 30 | 51.5 | 43.8 | 1.18 |
| | | 45 | 39.8 | 30.7 | 1.30 |
| 3-2 | Conventional product | 15 | 156.9 | 117.9 | 1.38 |
| | | 30 | 68.3 | 45.4 | 1.51 |
| | | 45 | 52.2 | 30.9 | 1.70 |
| 3-3 | Conventional product | 15 | 143.7 | 53.4 | 1.94 |
| | | 30 | 66.7 | 27.8 | 2.41 |
| | | 45 | 54.3 | 20.2 | 2.72 |

Table 3 shows no large difference between the product of the present invention and the conventional products when the measurements are taken in the direction of working. In terms of the angle (deflected angle) 15° from the specular reflection, both the product of the invention and the conventional products have L-values in excess of 50 in the direction of working. This indicates that the Samples 3-1 to 3-3 were produced through the working not under a dry condition but under a wet condition. If attention is given to the results measured in the direction of right angles, the product of the present invention has an L-value smaller than those of the conventional products. This is because the surfaces were effectively suppressed from being scratched and hence the surfaces were suppressed from being roughened by the scratches, contributing to decreasing the irregularly reflected light rays. In terms of the ratio in the direction of right angles and in the direction of working, therefore, the product of the present invention has a ratio which is close to 1, i.e., lies within a range of 0.7 to 1.3.

At deflected angles of 30° and 45°, too, the product of the invention exhibited L-values that were nearly the same in both the direction of height of the can and in the circumferential direction like in the case of the deflected angle of 15°. With the conventional products, the L-values were larger in the direction of right angles.

Experimental Examples 7 and 8

Experiments were conducted to make sure if a smooth ironing die with its surface coated with a diamond film exhibits its capability of suppressing the adhesion. Concretely speaking, blank cans were produced in Experimental Example 7 in the same manner as in Experimental Example 1 but using a brand-new ironing die and producing the products continuously. The obtained blank cans are all referred to as Samples 4-1. The Samples 4-1 were measured for their surface roughness Ra in the same manner as in Experimental Example 1, and it was observed how the roughness on the outer surfaces of the can walls of the blank cans would vary as the blank cans were continued to be produced. In Experimental Example 8, further, a cemented carbide mold was really used for producing at least not less than 40,000 cans and, thereafter, metals adhered to the mold were removed. By using this mold again, the blank cans were continuously produced in the same manner as in Experimental Example 7. The obtained blank cans are all referred to as Samples 4-2. Concerning the Samples 4-2, too, like the Samples 4-1, it was observed how the roughness on the outer surfaces of the can walls of the blank cans would vary as the blank cans were continued to be produced. Table 4 shows arithmetic mean roughness Ra1 on the outer surfaces of the can walls of the Samples 4-1 and Samples 4-2 as well as the ratios Ra1/Ra2 of the arithmetic mean roughnesses in the direction of right angles and in the direction of working. The ratios are average values of the two cans that are arbitrarily taken out after the cans have been produced in arbitrary numbers. For instance, a value "0.020" of Ra1 described in the column of the number of times of work of 5,000 cans (Samples 4-1) represents an average value of the two cans arbitrarily taken out from 5000±100 cans continuously produced in Experimental Example 7.

TABLE 4

| Sample | | Number of times of work | Direction at right angles Ra1 (μm) | Ra1/Ra2 |
|---|---|---|---|---|
| 4-1 | this invention | 2,000 cans | 0.028 | 1.09 |
| | | 5,000 cans | 0.020 | 1.14 |
| | | 20,000 cans | 0.024 | 0.98 |
| | | 40,000 cans | 0.026 | 1.13 |
| | | 80,000 cans | 0.023 | 1.31 |
| | | 160,000 cans | 0.024 | 1.06 |

TABLE 4-continued

| Sample | | Number of times of work | Direction at right angles Ra1 (μm) | Ra1/Ra2 |
|---|---|---|---|---|
| 4-2 | conventional products | 2,000 cans | 0.029 | 1.14 |
| | | 5,000 cans | 0.028 | 1.25 |
| | | 19,000 cans | 0.030 | 1.35 |
| | | 35,000 cans | 0.032 | 1.51 |
| | | 65,000 cans | 0.031 | 1.57 |
| | | 80,000 cans | 0.033 | 1.58 |

Table 4 tells that up to the number of times of work of about 2,000 cans, there is no large difference in the surface roughness Ra1 in the direction at right angles between the Samples 4-1 and the Samples 4-2, or in the ratio Ra1/Ra2. As the number of times of work increases in Experimental Example 8 (producing the Samples 4-2) by using the cemented carbide mold, the surface roughness increases in the direction at right angles, and the ratio Ra1/Ra2 increases, too. As the production continues to go beyond 35,000 cans, the surface roughness Ra1 becomes not smaller than 0.030 μm and the ratio Ra1/Ra2 becomes larger than 1.5 though dependent upon the individual products. This means that the worked article is scratched in the direction of working due to the adhesion of the component of the worked article on the mold. In Experimental Example 7 that uses the mold of which the surface has been coated with the diamond film, both the surface roughness Ra1 in the direction at right angles and the ratio Ra1/Ra2 remained the same as the initial values even after 160,000 cans were produced, effectively suppressing the component of the worked articles from adhering on the mold and, further, suppressing the worked articles from being scratched by the adhered metal component.

The invention claimed is:

1. A draw-ironed blank can having a can body made of an aluminum alloy, wherein on an outer surface of the can body, a ratio Ra1/Ra2 of an arithmetic mean roughness Ra1 measured in a circumferential direction and an arithmetic mean roughness Ra2 measured in a direction of height is from 0.5 to 1.5, the arithmetic mean roughness Ra1 being not more than 0.030 μm, and a brightness ratio which is measured by an LCH (Lightness, Chroma, and Hue) method and represented by the following formula is from 0.7 to 1.3, brightness ratio $=L15_w/L15_h$ wherein, $L15_w$ is a brightness value of a light reflected by the outer surface of the can body having an angle of 15 degrees based on a specular light in the circumferential direction of the outer surface of the can body, $L15_h$ is a brightness value of the light reflected by the outer surface of the can body having an angle of 15 degrees based on a specular light in the direction of height of the outer surface of the can body, and said brightness value $L15_h$ is not less than 50.

2. A method of producing the draw-ironed blank can according to claim 1, which comprises subjecting a draw-formed can obtained by draw-forming a metallic disk to draw-ironing work using an ironing die provided with a diamond film and having a work surface of a surface roughness Ra of not more than 0.1 μm, wherein the draw-ironing work is carried out under a wet condition in the presence of a coolant and at an ironing ratio of not more than 50%.

* * * * *